US009435557B2

(12) United States Patent
Albrecht et al.

(10) Patent No.: US 9,435,557 B2
(45) Date of Patent: Sep. 6, 2016

(54) CONTROL UNIT FOR AN HVAC SYSTEM COMPRISING AN ECONOMIZER AND METHOD FOR OPERATING SUCH CONTROL UNIT

(71) Applicant: BELIMO Holding AG, Hinwil (CH)

(72) Inventors: Daniel Albrecht, Gruet (CH); Ronald Aeberhard, Gruet (CH); Guido Hofstetter, Wolfhausen (CH); Darryl Deangelis, Longmeadow, MA (US)

(73) Assignee: BELIMO Holding AG, Hinwil (CH)

( * ) Notice: Subject to any disclaimer, the term of this patent is extended or adjusted under 35 U.S.C. 154(b) by 639 days.

(21) Appl. No.: 13/749,007

(22) Filed: Jan. 24, 2013

(65) Prior Publication Data

US 2014/0207288 A1 Jul. 24, 2014

(51) Int. Cl.

| | |
|---|---|
| ***G05D 23/00*** | (2006.01) |
| ***F24F 11/00*** | (2006.01) |
| *F24F 7/08* | (2006.01) |

(52) U.S. Cl.

CPC ..... *F24F 11/0001* (2013.01); *F24F 7/08* (2013.01); *F24F 11/0015* (2013.01); *F24F 2011/0006* (2013.01); *F24F 2011/0016* (2013.01)

(58) Field of Classification Search

CPC ..... G05B 19/414; G05B 2219/2614; G05B 19/054; G05B 2219/21015; G05B 19/0423; G05B 2219/21012; G05B 2219/21014; G05B 2219/24146; F24F 2011/0067

See application file for complete search history.

(56) References Cited

U.S. PATENT DOCUMENTS

| | | | | |
|---|---|---|---|---|
| 4,267,967 | A | 5/1981 | Beck et al. | |
| 4,379,484 | A | 4/1983 | Lom et al. | |
| 4,389,853 | A | 6/1983 | Hile | |
| 4,399,862 | A | 8/1983 | Hile | |
| 4,404,815 | A | 9/1983 | Gilson | |
| 4,549,601 | A | 10/1985 | Wellman et al. | |
| 5,333,783 | A * | 8/1994 | Catan | G05D 23/1393 165/214 |
| 5,544,809 | A | 8/1996 | Keating et al. | |
| 5,628,533 | A * | 5/1997 | Hill | B65D 50/046 292/80 |

(Continued)

FOREIGN PATENT DOCUMENTS

| | | | |
|---|---|---|---|
| CA | 2520975 | A1 | 4/2007 |
| WO | 2009073496 | A1 | 6/2009 |

OTHER PUBLICATIONS

Installer Guide; 2008 Braeburn Systems LLC; Pub. No. 5400-100-007; 10 pgs.

(Continued)

*Primary Examiner* — Darrin Dunn

(74) *Attorney, Agent, or Firm* — Sughrue Mion, PLLC

(57) ABSTRACT

A control unit (22) for an HVAC system (10) comprises an economizer (EC), which economizer (EC) is configured to introduce outdoor air (OA) into the HVAC system (10) for cooling and/or ventilation purposes in a manner controlled by said control unit (22), said control unit (22) comprising a base module (23) with: a control circuit (24), a man machine interface (25) connected to said control circuit (24), and first I/O means for connecting at least one sensor (32, . . . , 36) of said HVAC system to said control circuit (24) and for delivering at least one control signal from said control circuit (24) to control the operation of said economizer (EC).

Said base module (23) is configured to optionally receive at least one extension module (26, 27, 28), which can be snapped on and electrically connected to said base module (23) for expanding the functionality of said control unit (22).

23 Claims, 4 Drawing Sheets

(56) References Cited

U.S. PATENT DOCUMENTS

| | | | | |
|---|---|---|---|---|
| 5,971,067 | A | 10/1999 | Rayburn et al. | |
| 6,161,764 | A | 12/2000 | Jatnieks | |
| 6,298,912 | B1 | 10/2001 | Rayburn et al. | |
| 6,346,041 | B1 | 2/2002 | Desmond et al. | |
| 6,415,617 | B1 | 7/2002 | Seem | |
| 6,634,422 | B2 | 10/2003 | Rayburn et al. | |
| 7,434,413 | B2 | 10/2008 | Wruck | |
| 8,066,558 | B2 | 11/2011 | Thomle et al. | |
| 8,195,335 | B2 | 6/2012 | Kreft et al. | |
| 2002/0090908 | A1 | 7/2002 | Estepp | |
| 2003/0042015 | A1 | 3/2003 | Rayburn et al. | |
| 2003/0181158 | A1 | 9/2003 | Schell et al. | |
| 2005/0095978 | A1 | 5/2005 | Blunn et al. | |
| 2005/0149232 | A1 | 7/2005 | Shah et al. | |
| 2006/0091227 | A1 | 5/2006 | Attridge, Jr. | |
| 2006/0130502 | A1 | 6/2006 | Wruck et al. | |
| 2006/0234621 | A1 | 10/2006 | Desrochers et al. | |
| 2007/0128927 | A1* | 6/2007 | Cleveland | H01R 13/68 439/535 |
| 2007/0149109 | A1 | 6/2007 | Gu et al. | |
| 2008/0076346 | A1 | 3/2008 | Ahmed | |
| 2008/0179408 | A1 | 7/2008 | Seem | |
| 2008/0179409 | A1 | 7/2008 | Seem | |
| 2008/0194194 | A1 | 8/2008 | Boxhoorn | |
| 2009/0083583 | A1 | 3/2009 | Seem et al. | |
| 2010/0170272 | A1* | 7/2010 | Deangelis | F24F 11/0086 62/157 |
| 2011/0046790 | A1 | 2/2011 | Miller et al. | |
| 2011/0097988 | A1 | 4/2011 | Lord | |
| 2011/0127340 | A1 | 6/2011 | Aiken | |
| 2011/0264273 | A1 | 10/2011 | Grabinger et al. | |
| 2012/0052791 | A1 | 3/2012 | Kurelowech | |
| 2012/0092060 | A1* | 4/2012 | Ganesan | H03K 17/0824 327/419 |
| 2012/0258609 | A1* | 10/2012 | Warneke | H01R 9/2433 439/43 |
| 2012/0273581 | A1* | 11/2012 | Kolk | F24F 11/006 236/91 D |
| 2012/0310420 | A1 | 12/2012 | Quirk | |
| 2013/0009927 | A1* | 1/2013 | Lowles | G09G 3/3406 345/207 |
| 2013/0013117 | A1 | 1/2013 | Desrochers | |
| 2013/0158724 | A1* | 6/2013 | Nickerson | A01G 25/16 700/284 |
| 2015/0204565 | A1* | 7/2015 | Amundson | F24F 11/0086 700/276 |

OTHER PUBLICATIONS

Zhou Xiaohui, "A plug and play framework for an HVAC air handling unit and temperature sensor auto recognition technique" (2010). Graduate Theses and Dissertations. Paper 11496.

Braeburn Premier Model 5400 Light Commercial and Residential Thermostat; Montgomery, Illinois—Jan. 21, 2008; 1 pg.

Georg Neugschwandtner; Towards Plug and Play in Home and Building Automation Networks; Automation Systems Group, Inst. Of Computer Aided Automation, TU Vienna, Austria; 1-4244-0681-1/06/$20.00; 2006 IEEE; pp. 461-464, Sep. 2006.

Technical Reference Manual; Design and Application Guide for Honeywell Economizer Controls; Honeywell; 63-8594 Honeywell Economizers; 192 pgs.

Honeywell; Jade (TM) Economizer Module (Model W7220); 24 pgs.

Trane Engineers Newsletter; vol. 35-2; providing insights for today's hvac system designer; Airside Economizers; pp. 1-8, May 2000.

* cited by examiner

CONTROL UNIT FOR AN HVAC SYSTEM COMPRISING AN ECONOMIZER AND METHOD FOR OPERATING SUCH CONTROL UNIT

BACKGROUND OF THE INVENTION

The present invention relates to systems for heating, ventilation and air conditioning (HVAC systems). It refers to a control unit for an HVAC system according to the preamble of claim 1. It further refers to a method for operating such a control system.

PRIOR ART

It is an established fact that airside economizing (using outdoor air as a cooling medium when conditions are suitable) is one of the smartest ways for buildings to save energy. But setting up controls to match the specific climate profiles and code requirements of different regions usually involves a cumbersome set of tasks.

Airside economizing is not only a good way to reduce operating costs; but it is a requirement in most non-residential HVAC systems in various countries, especially throughout the United States. Airside economizers also fulfil another important requirement for buildings by providing the correct ratio of outside air and return air to deliver proper indoor air quality (IAQ) to meet certain codes.

In the past, several solutions have been proposed with regard to HVAC systems or rooftop units (RTUs) comprising an economizer.

Document U.S. Pat. No. 6,161,764 discloses an enhanced controller for an air conditioning system incorporating mechanical cooling equipment and an economizer, the enhanced controller including circuits for producing signals indicative of commanded changes in temperature of air admitted into the air conditioned space and of a non-temperature parameter, such as carbon dioxide concentration, of air within the space. The signals are supplied to a logic circuit which produces a ventilation damper control signal based on which of the temperature and non-temperature parameters requires greater change. Freeze protection, and maximum and minimum damper position circuits override the basic damper control signal to avoid excessively low space temperatures and to provide air exchange limits.

Document U.S. Pat. No. 7,434,413 B2 discloses a controller for an HVAC system, the controller having inputs and outputs for receiving information from and sending commands to components of an HVAC system including one or more sensors, a fan, cooling equipment, and fresh air ventilation components. The controller is configured to perform the following steps: determining whether a component or sensor of the HVAC system is operational; if so, performing a first HVAC method; or if not, performing a second HVAC method.

Document U.S. Pat. No. 8,066,558 B2 teaches a method of controlling ventilation of an environment, the method comprising the steps of: monitoring an indication of occupancy of the environment; modifying a relative amount of fresh air provided to the environment in response to the indication of occupancy; and providing a set amount of fresh air to the environment if the indication of occupancy is erroneous.

Document U.S. Pat. No. 8,195,335 provides a method for controlling an economizer of an HVAC system. The economizer has an outside air stream of incoming outside air, a return air stream of return air, and a mixed air stream of mixed incoming outside air and return air that is provided to the cooling unit of the HVAC system. The economizer also includes one or more controllable dampers for controlling a mixing ratio of incoming outside air to return air in the mixed air stream. The control method includes positioning the one or more controllable dampers in first and second configurations such that the mixed air stream has first and second mixing ratios of incoming outside air to return air in the mixed air stream. The method also includes recording first and second measures related to the temperature of the mixed air stream when the dampers are in each of the first and second configurations. First and second measures related to other parameters of the mixed air stream may be recorded as well. Based on the recorded first and second measures related to the temperature of the mixed air stream and possibly other recorded measures related to mixed air stream parameters, the method determines whether and/or how much of the incoming outside air to admit into the economizer via the one or more controllable dampers during subsequent operation of the HVAC system.

Document US 2010/0170272 A1 describes an air conditioning economizer system, wherein outdoor air intake is reduced automatically by a control device based on a shut-off control setting for a measured outdoor air quality. A geographical location associated with the air conditioning economizer system is received in the control device. The control device defines automatically the shut-off control setting based on the geographical location. Thus, the air conditioning economizer system is adapted specifically for a geographic location and its climate zone, without the requirement for installing or operating personnel to determine a shut-off control setting for a specific climate zone and/or select a corresponding operating range.

Document US 2011/0264273 A1 discloses methods and systems for remotely monitoring and/or controlling a demand control ventilation system are disclosed. In one illustrative embodiment, a demand control ventilation device having a damper and a controller are provided. The damper may have a range of damper positions for controlling a flow of outside air into the building. The controller controls the damper positions such that a desired flow of outside air is drawn through the damper and into the building. A remote monitoring device may also be provided. The remote monitoring device may be located remotely from the demand control ventilation device, but in communication with or part of the controller. In some instances, the remote monitoring device may have a user interface for remotely monitoring and/or controlling at least certain aspects of the demand control ventilation system from the remote location.

Document US 2011/0264274 A1 discloses a method and system for operating a demand control ventilation system with a multi-speed fan. The control system may modulate the fan speed of a multi-speed fan and/or the position of a ventilation damper in order to achieve desired ventilation levels for a building.

Unfortunately, having an economizer system doesn't necessarily mean that the expected energy savings are accomplished. Studies have shown that up to 70% of economizers are not functioning properly. Many times economizer systems are set up incorrectly or are simply left to operate in factory default mode. Even worse, because economizer failures generally do not result in comfort problems many failures go undetected.

SUMMARY OF THE INVENTION

It is an object of the invention, to provide a control unit for a HVAC system with economizer, which control unit is easy to use and set up correctly, has an enhanced flexibility and can easily be adapted to different environments.

It is another object of the invention to provide a method for operating such a control unit.

These and other objects are obtained by a control unit as described and claimed.

A control unit according to the invention is intended for an HVAC system comprising an economizer, which economizer is configured to introduce outdoor air into the HVAC system for cooling and/or ventilation purposes in a manner controlled by said control unit. Said control unit comprises a base module with: a control circuit, a man machine interface connected to said control circuit, and first I/O means for connecting at least one sensor of said HVAC system to said control circuit and for delivering at least one control signal from said control circuit to control the operation of said economizer. Said base module is configured to optionally receive at least one extension module, which can be snapped on and electrically connected to said base module for expanding the functionality of said control unit.

According to an embodiment of the invention said base module is configured to receive said at least one extension module such that the electrical connection between said at least one extension module and said base module is automatically established, when said at least one extension module is snapped on said base module.

Specifically, a plug-in connector is provided for electrically connecting said base module and said at least one extension module, one part of said plug-in connector being integrated into said base module and the other part of said plug-in connector being integrated into said at least one extension module.

According to another embodiment of the invention said base module is configured to receive a plurality of extension modules, whereby plug-in connectors are provided for electrically connecting said base module and each of said extension modules, one part of each plug-in connector being integrated into said base module and the other part of each plug-in connector being integrated into an extension module, and whereby said plug-in connectors are individualized (coded) so that each plug-in connector can only be used with one type of extension module.

Specifically, said base module is provided with first latching means and said at least one extension module is provided with second latching means configured to cooperate with said first latching means such that said at least one extension module is locked in place on said base module, when it is plugged into said plug-in connector.

More specifically, said first and second latching means comprise an elastically bendable snapping clip and one or more catches, whereby said snapping clip glides over and latches behind said catches, when said at least one extension module) is plugged into said plug-in connector, and said at least one extension module can be released by elastically bending said snapping clip.

Even more specifically, said elastic snapping clip is provided at said at least one extension module, and said catches are arranged at said base module.

According to a further embodiment of the invention said at least one extension module is provided with second I/O means for electrically connecting said at least one extension module and thereby said base module with further units being relevant for the operation of the HVAC system.

Specifically, said at least one extension module is configured to enable a demand controlled ventilation operation of the HVAC system, and said second I/O means comprises input means for a CO2 sensor and output means for controlling an exhaust fan within said HVAC system.

More specifically, said second I/O means comprise further output means for controlling an indoor fan within said HVAC system.

Alternatively, said at least one extension module is configured to enable a communication with remote devices.

Specifically, said remote devices comprise an alarm device.

Specifically, said remote devices comprise a remote unit for exchanging data with said control unit.

According to another embodiment of the invention said base module comprises a base plate and a housing mounted on said base plate, which housing encloses said control circuit and said man machine interface, whereby said housing comprises on its upper side an I/O platform, on which said first I/O means is arranged, and which is configured to receive said at least one extension module, and further comprises an MMI housing part, which projects from said I/O platform and contains said man machine interface.

Specifically, said first I/O means comprises a plurality of connector rows, which are arranged in a separate I/O area.

Specifically, said at least one extension module can be snapped on said base module outside said I/O area without changing the footprint of said base module.

Specifically, each said connector row comprises a plurality of individual male spade connectors.

According to a further embodiment of the invention, said first I/O means comprises first connecting means for connecting an actuator, second connecting means for connecting a thermostat, third connecting means for connecting a supply air temperature sensor, fourth connecting means for connecting an outdoor air temperature sensor, fifth connecting means for connecting an outdoor air humidity sensor, sixth connecting means for connecting a return air temperature sensor, and seventh connecting means for connecting a return air humidity sensor.

Specifically, said control circuit and said sensor connecting means are configured to be connected to analog sensors.

Specifically, said first connecting means for connecting an actuator comprises a separate connector for receiving a feedback signal from said actuator, said feedback signal containing information about the actual position of said actuator.

Specifically, said first I/O means further comprises eighth connecting means for connecting first and second compressors of a two-stage cooling device within said HVAC system.

According to another embodiment of the invention said man machine interface comprises a display for displaying menu points, onboard information, set values and real time operating information, a plurality of push buttons for inputting various commands, and a plurality of optical indicators for indicating status information.

Specifically, said display is an enhanced transflective backlit LCD display, especially with an extended temperature range, with two rows of 16 characters each.

Specifically, said plurality of push buttons comprises a separate help button for retrieving and displaying context sensitive help information stored with said control circuit.

In a method according to the invention for operating an inventive control unit to control a HVAC system, which comprises means for cooling the air passing through said HVAC system, said control unit has to be set up by an operator before it is able to automatically control the cooling operation of said cooling means.

According to an embodiment of the inventive method said economizer of said HVAC system comprises a damper for controlling the inflow of outdoor air into the HVAC system, and at least a minimum position of said damper has to be set up and a parameter representative of the climate zone at the location of said HVAC system, preferably the ZIP code, has to be entered before said control unit is able to automatically control the cooling operation of said cooling means.

According to an embodiment of the inventive method said man machine interface comprises a display for displaying menus, which contain references to devices attached to and connected with said base module, and said references are automatically not shown in the menus displayed, when the respective device is not attached to and connected with said base module.

Specifically, said control unit has to be initially set up by an operator before it is able to automatically control the operation of said HVAC system, and a prompt for an additional setup is generated by said base unit and displayed on said display, when a new device is attached to and connected with said base unit.

More specifically, a new function of said control unit associated with said new device is only implemented by said control unit, when said additional setup is done.

Specifically, context sensitive help information to be displayed an said display is stored in said control circuit, whereby the menu displayed on said display indicates, when a context sensitive help information is available for a certain menu point, and said context sensitive help information is displayed on said display, when an operator pushes a specific help button at said man machine interface.

In a method according to the invention for operating an inventive control unit to control a HVAC system, which comprises means for cooling the air passing through said HVAC system, a multi-speed indoor fan, an exhaust fan and a damper for controlling the inflow of outdoor air into the HVAC system, said control unit allows a service technician to manually operate said cooling means and said exhaust fan, and to select the speed of the indoor fan and the position of the damper for a certain temporary period for commissioning, maintenance or service.

In a method according to the invention for operating an inventive control unit an alarm is initiated by said control unit, when a failure and/or malfunctioning of the control is detected by said control unit.

Specifically, an alarm is initiated by said control unit, when a sensor connected to said control unit returns a signal value out of its normal working range, or when a sensor, which should be connected to said control unit, is not detected.

More specifically, the control strategy of the HVAC system is changed by said control unit when a sensor, which should be connected to said control unit, is not detected, according to the following table:

| | Compulsory sensors | | | | Failed sensors | | | |
|---|---|---|---|---|---|---|---|---|
| Economizing Strategy | OAT | OAH | RAT | RAH | OAT | OAH | RAT | RAH |
| Economizing disabled | | | | | ↑ | ↑ | ↑ | ↑ |
| Single Temperature | x | | | | ↑ | ↑ | ↑ | ↑ |
| Differential Temperature | x | | x | | ↑ | ↑ | ↑ | ↑ |
| Single Enthalpy | x | x | | | ↑ | ↑ | ↑ | ↑ |
| Differential Enthalpy | x | x | x | x | ↑ | ↑ | ↑ | ↑ |

*Economizing is enabled @ RAH <55% rH/disabled @ RAH >65% rH whereby OAT is an outdoor air temperature sensor, OAH is an outdoor air humidity sensor, RAT is a return air temperature sensor and RAH is a return air humidity sensor.

Specifically, an alarm is initiated and an associated function is disabled by said control unit, when a device, which should be connected to said control unit, is no longer detected by said control unit.

More specifically, said device is one of a CO2 sensor, exhaust fan and indoor fan.

According to another embodiment of the invention, before normal operation, said control unit is run through test and verification sequences to support and ensure compliance with certain standards and/or regulations.

Specifically, a built-in test routine is run in a step-by-step operation with visual verification, and wherein during said test mode a damper actuator of the economizer is commanded to temporarily run with a higher speed in order to save time in completing the test.

More specifically, in the process of running an acceptance test, if the damper rotation is intentionally limited, said control unit will adapt to the intended angle to provide full resolution.

According to another embodiment of the invention, said control unit counts and maintains for statistical purposes certain parameters of its operation including: hours of operation in demand controlled ventilation mode, of compressors), in economizing mode, in integrated cooling mode, in ventilation mode, in heating mode, and unoccupied.

According to another embodiment of the invention, to enable a service technician to identify a potential problem, alarms are stored within said control unit.

According to another embodiment of the invention, in case of a blackout or brownout, said control unit shuts down compressors of said cooling means and prevents compressors of said cooling means from being enabled.

Specifically, when after a blackout or brownout power is restored to normal levels, or when an initial power-up takes place, said compressors are enabled in a random fashion to prevent multiple compressors in multiple rooftop units from starting at the same time in order to prevent a power drain that could initiate a blackout or brownout situation.

According to another embodiment of the invention, operation of compressors of said cooling means is adapted to optimize energy consumption and at the same time increase comfort and lifetime of the components.

Specifically, the cooling means and compressors are protected by a minimum on/off time, of more than 10 sec, preferably of 3 min, or more.

Specifically, the number of on/off cycles per hour of the cooling means and compressors is limited.

Specifically, said cooling means is a cooling device and a special temperature threshold is determined to deny or enable operation of said cooling device.

Specifically, said cooling means is a cooling device, and wherein said control unit at an initial cooling call from a thermostat will first try to satisfy said cooling call with reduced cooling power, and delay the activation of full cooling power.

According to another embodiment of the invention, an exhaust fan is provided in said HVAC system, and the operation of said exhaust fan is stabilized by a logic combination of: a minimum exhaust fan on and off time, adjusting a supply air temperature setpoint, choosing a gradient of supply air temperature change, adjusting damper to maintain supply air respectively mixed air setpoint, and making an adaptive change of an on/off threshold for said exhaust fan.

According to another embodiment of the invention, an indoor fan and an exhaust fan are provided in said HVAC system, and a threshold of said exhaust fan is adjusted dependent on the speed of said indoor fan.

According to another embodiment of the invention, operation of compressors of said cooling means is monitored by looking at a drop in supply or mixed air temperature (SAT/MAT), which is to be expected after a compressor is switched on, and generating an alarm, if such an expected temperature drop is missed.

According to another embodiment of the invention, an internal voltage is monitored, and a brownout is detected based on a long-term and momentary development of said internal voltage, and wherein said internal voltage is derived from the voltage and/or frequency of a primary or secondary power supply, especially by detecting a voltage drop of a predetermined percentage.

BRIEF DESCRIPTION OF THE DRAWINGS

The present invention is now to be explained more closely by means of different embodiments and with reference to the attached drawings.

FIG. 2 is a top view of a control unit according to an embodiment of the invention with three extension modules snapped on;

FIG. 3 is a perspective side view of a base unit of the control unit according to FIG. 2 with an extension module in form of an energy module on the way of being snapped on;

FIG. 4 is a perspective side view of the configuration according to FIG. 3 with the extension module being snapped on; and FIG. 5 is a perspective top view of the control unit according to FIG. 4 with a further extension module in form of a communication module being snapped on.

DETAILED DESCRIPTION OF DIFFERENT EMBODIMENTS OF THE INVENTION

Figure 1:
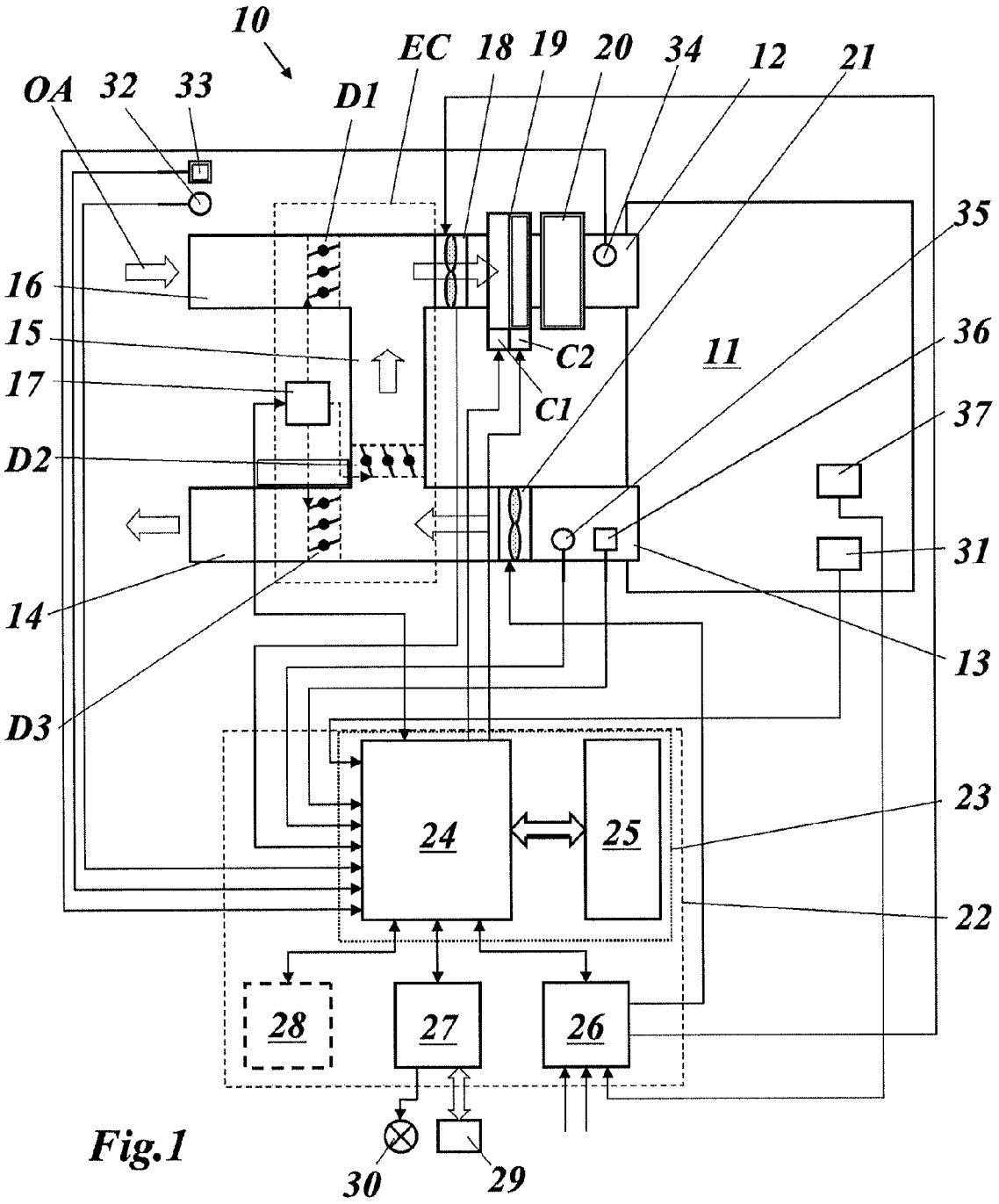
FIG. 1 shows a scheme of an exemplary HVAC system with economizer and a control unit according to an embodiment of the invention.

FIG. 1 shows a scheme of an exemplary HVAC system with economizer and a control unit according to an embodiment of the invention. The HVAC system 10 of FIG. 1 is connected to a space 11 for the purpose of heating, ventilation and air conditioning. The space 11 may be for example a room. The HVAC system 10 comprises a supply air duct 12, through which supply air is introduced into the space 11 at one side by means of an indoor fan 18. The temperature of the supply air is controlled in the example shown by a two-stage cooling device 19 with two compressors C1 and C2 and a heating device 20. The actual temperature of the supply air is measured a supply air temperature sensor 34. The supply air temperature sensor (SAT sensor) 34 is located downstream the cooling device (coil) 19; it may be located upstream or downstream the heating device 20 or in the supply air duct 12 into the space 11. A mixed air temperature sensor (MAT sensor) refers to a sensor, which is located in the mixing area of outdoor air and recirculating air.

Air from space 11 is conducted as return air through a return air duct 13 at another side of the space 11. The humidity and temperature of the return air are measured by means of return air temperature sensor 35 and return air humidity sensor 36. An exhaust fan 21 can be used to force the return air through return air duct 13.

The return air may be recirculated in a closed circuit through a recirculating duct 15, which connects supply air duct 12 and return air duct 13. However, recirculating duct 15 is part of a well-known economizer EC, which reduces energy consumption for the cooling of the supply air by introducing colder outdoor air OA through outdoor air intake duct 16 in a controlled manner. When outdoor air is supplied to space 11, a respective mass flow of air has to be removed from the circulating air flow and emitted as exhaust air through exhaust air duct 14. The mass flow ratios of outdoor air, exhaust air and recirculated are controlled (in the example shown) by means of three dampers D1, D2 and D3, which are moved by common damper actuator 17. In other configurations a single damper is sufficient to control these mass flows (see for example document US 2011/0097988 A1). For a proper operation of economizer EC humidity and temperature of the outdoor air OA are measured by means of outdoor air temperature sensor 32 and outdoor air humidity sensor 33.

Within space 11 a thermostat 31 is provided, which delivers commands for heating or cooling the air in space 11. For a demand-controlled ventilation (DCV) a CO2 sensor 37 may be provided in space 11 to sense the occupation of space 11 with people and initiate a supply of fresh air if necessary.

The operation of HVAC unit 10 is controlled by a control unit 22, which receives signals from the various sensors 32-37, commands from thermostat 31, and in certain cases status information from the system, e.g. information about the damper position. Control unit 22 comprises a control circuit 24 with a microprocessor, related memory and suitable control software, and a man machine interface (MMI) 25.

The control unit 22 is of modular design. It comprises a base module 23 with control circuit 24 and man machine interface 25, which displays status information, software-related menus for setup and control and enables manual input of commands, set up parameters, and the like. The base module 23 can be used as a stand-alone control. However, additional extension modules 26, 27 or 28 with additional I/O capability and/or interfaces can be added.

The modular design allows for future changes and/or adding new functionality on the same footprint. Extension module 27 is a communication module, which allows for current alarm output at alarm connectors 50, 51 and/or firmware update when required. Especially, it allows for future commissioning and trending tools and system integration into a Building Automation and Control network BACnet. With communication module 27 communication with exterior components or systems such as computers, Building Management Systems BMS, aggregates or sensors, is possible by means of communication connector 52, which may be for example of the RJ45 type.

Base module 23 is configured to optionally receive at least one extension module 26, 27, 28, which can be snapped on and electrically connected to base module 23 for expanding the functionality of control unit 22. The electrical connection between an extension module 26, 27, 28 and base module 23 is automatically established, when the extension module is snapped on base module 23. A plug-in connector 56, 57, 58 and 63 is provided for electrically connecting base module 23 and an extension module 26, 27 and 28, whereby one part of plug-in connector 56, 57, 58 and 63 is integrated into base module 23, and the other part is integrated into the extension module 26, 27 and 28. Plug-in connectors 56, 57, 58, 63 are coded so that each plug-in connector 56, 57, 58, 63 can only be used with one type of extension module.

Figure 3:
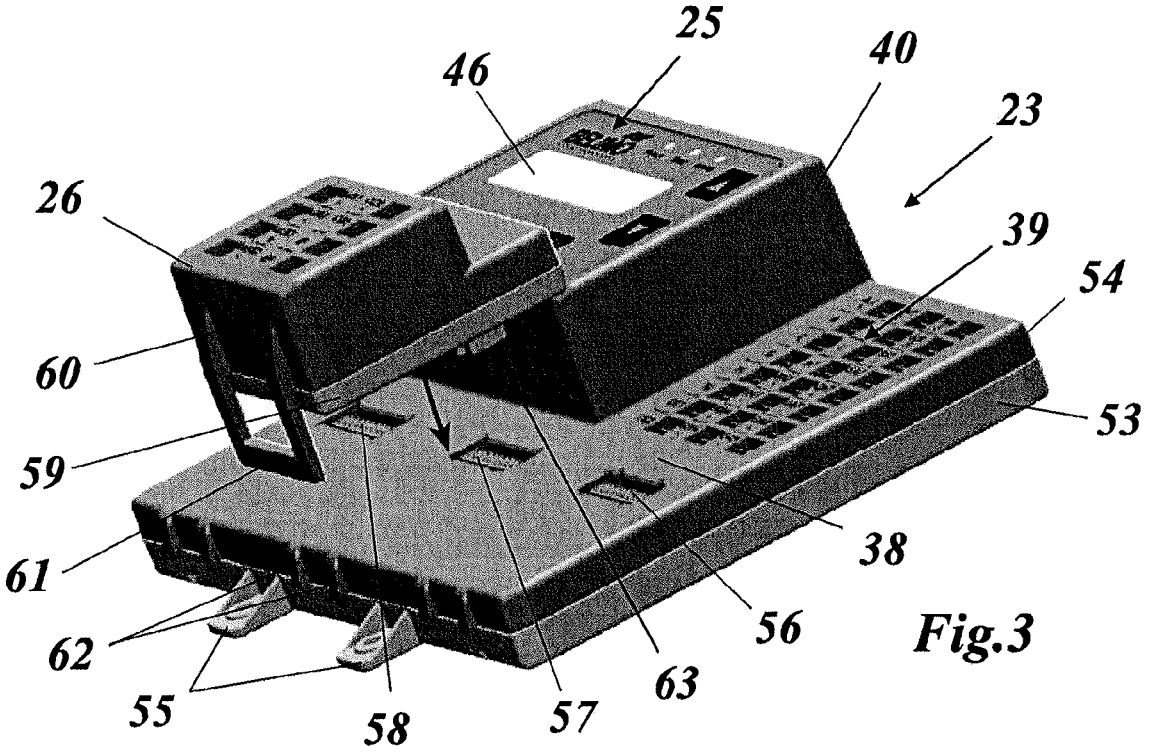
Figure 4:
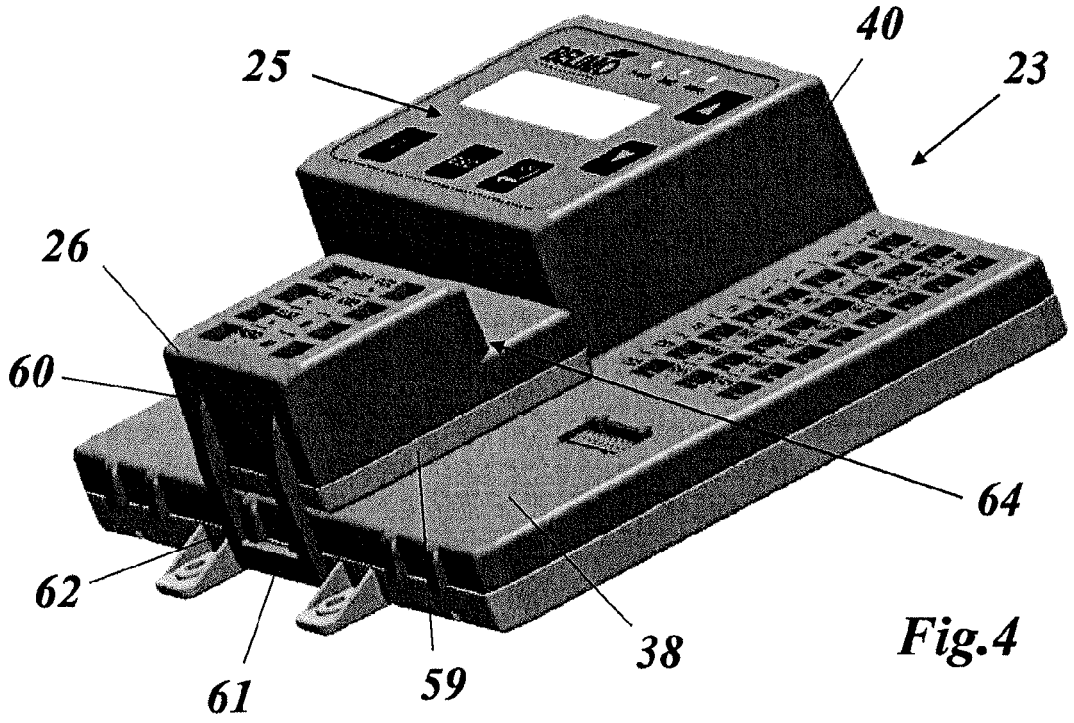

Base module 23 is provided with first latching means 62, and extension modules 26, 27 and 28 are each provided with second latching means 61 configured to co-operate with first latching means 62 such that an extension module 26, 27, 28 is locked in place on base module 23, when it is plugged into plug-in connector 56, 57, 58, 63. Said first and second latching means 61, 62 comprise an elastically bendable snapping clip 61 at the extension module and one or more catches 62, which are arranged at base module 23. Snapping clip 61 glides over and latches behind said catches 62, when an extension module 26, 27, 28 is plugged into plug-in connector 56, 57, 58, 63 (FIG. 3→FIG. 4). On the other hand, snapped-on extension module 26, 27, 28 can be released by elastically bending snapping clip 61 outwards.

Extension module 26 is for example configured as an energy module and is provided with I/O means CR4, CR5 and 50, 51, 52 for electrically connection with further units 18, 21, 29, 30 and 37 being relevant for the operation of HVAC system 10. The energy module is configured to enable a demand controlled ventilation (DCV) operation of HVAC system 10. Therefore, said second I/O means comprises input means +CO2, −CO2 for a CO2 sensor 37 and output means IF, EF for controlling indoor fan 18 and exhaust fan 21 within HVAC system 10. Auxiliary Input means +AUX and −AUX may be used for a remote potentiometer or a purge contact.

Extension module 27 is configured as a communication module to enable a communication with remote devices, especially an alarm device 30 (e.g. a lamp), or a remote unit 29 for exchanging data with control unit 22. Date exchange is done via a communication connector 52, e.g. of the RJ45 type.

Figure 2:
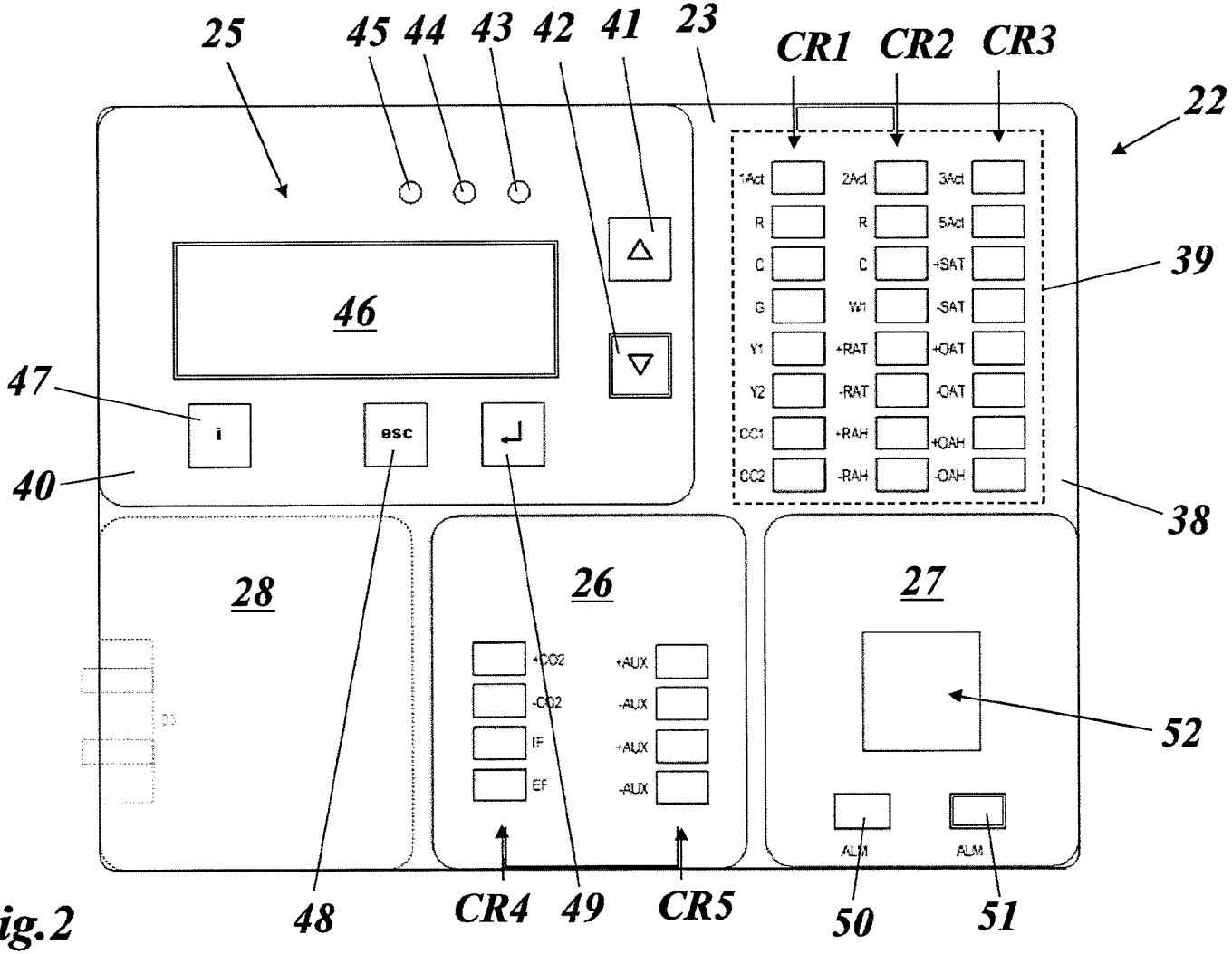

Base module 23 comprises a base plate 53 and a housing 54 mounted on base plate 53. Housing 54 encloses control circuit 24 and man machine interface 25. Housing 54 has on its upper side an I/O platform 38, on which I/O means 39 and connector rows CR1, CR2, CR3 is arranged. I/O platform 38 is configured to receive extension modules 26, 27, and 28. It further comprises an MMI housing part 40, which projects from I/O platform 38 and contains man machine interface 25. Connector rows CR1, CR2 and CR3 are arranged in a separate I/O area 39. Advantageously, extension modules 26, 27 and 28 can be snapped on base module 23 side by side and outside I/O area 39 without changing the footprint of base module 23. Connector rows CR1, CR2 and CR3 each comprise a plurality of individual male spade connectors, which have in the embodiment shown in FIG. 2 the following functions:

Connector Row CR1:

| | |
|---|---|
| 1Act | actuator supply common (damper actuator 17) |
| R | supply hot |
| C | supply common |
| G | fan signal (occupied) |
| Y1 | cooling requirement stage 1 (from thermostat 31) |
| Y2 | cooling requirement stage 2 (from thermostat 31) |
| CC1 | compressor C1 |
| CC2 | compressor C2 |

Connector Row CR2:

| | |
|---|---|
| 2Act | actuator supply hot (damper actuator 17) |
| R | supply hot |
| C | supply common |
| W1 | heating requirement stage 1 (from thermostat 31) |
| +RAT | return air temperature (sensor 35) |
| −RAT | return air temperature (sensor 35) |
| +RAH | return air humidity (sensor 36) |
| −RAH | return air humidity (sensor 36) |

Connector Row CR3:

| | |
|---|---|
| 3Act | actuator control input (damper actuator 17) |
| 5Act | actuator feedback signal (damper actuator 17) |
| +SAT | supply air temperature (sensor 34) |
| −SAT | supply air temperature (sensor 34) |
| +OAT | outdoor air temperature (sensor 32) |
| −OAT | outdoor air temperature (sensor 32) |
| +OAH | outdoor air humidity (sensor 33) |
| −OAH | outdoor air humidity (sensor 33) |

Man machine interface 25 comprises a display 46 for displaying menu points, onboard information, set values and real time operating information, a plurality of push buttons 41, 42, 47, 48, 49 for inputting various commands, and a plurality of optical indicators 43, 44, 45 for indicating status information. Display 46 is preferably an enhanced transflective backlit LCD display with two rows of 16 characters each. An extended temperature range of display 46 (minimum −20° C. to 70° C.) prevents a blackout in cold climates or in a hot environment on a rooftop location. The transflective backlit feature allows for easy viewing in different lighting situations, e.g. when the sun is shining on the display.

One of push buttons 41, 42, 47, 48 and 49 is a separate help button 47 for retrieving and displaying context sensitive help information stored with control circuit 24. Arrow up and down buttons 41 and 42 enable to go up or down in a displayed menu, while enter button 49 is used for entering a command, and escape button 48 is used to leave a menu level.

Figure 5:
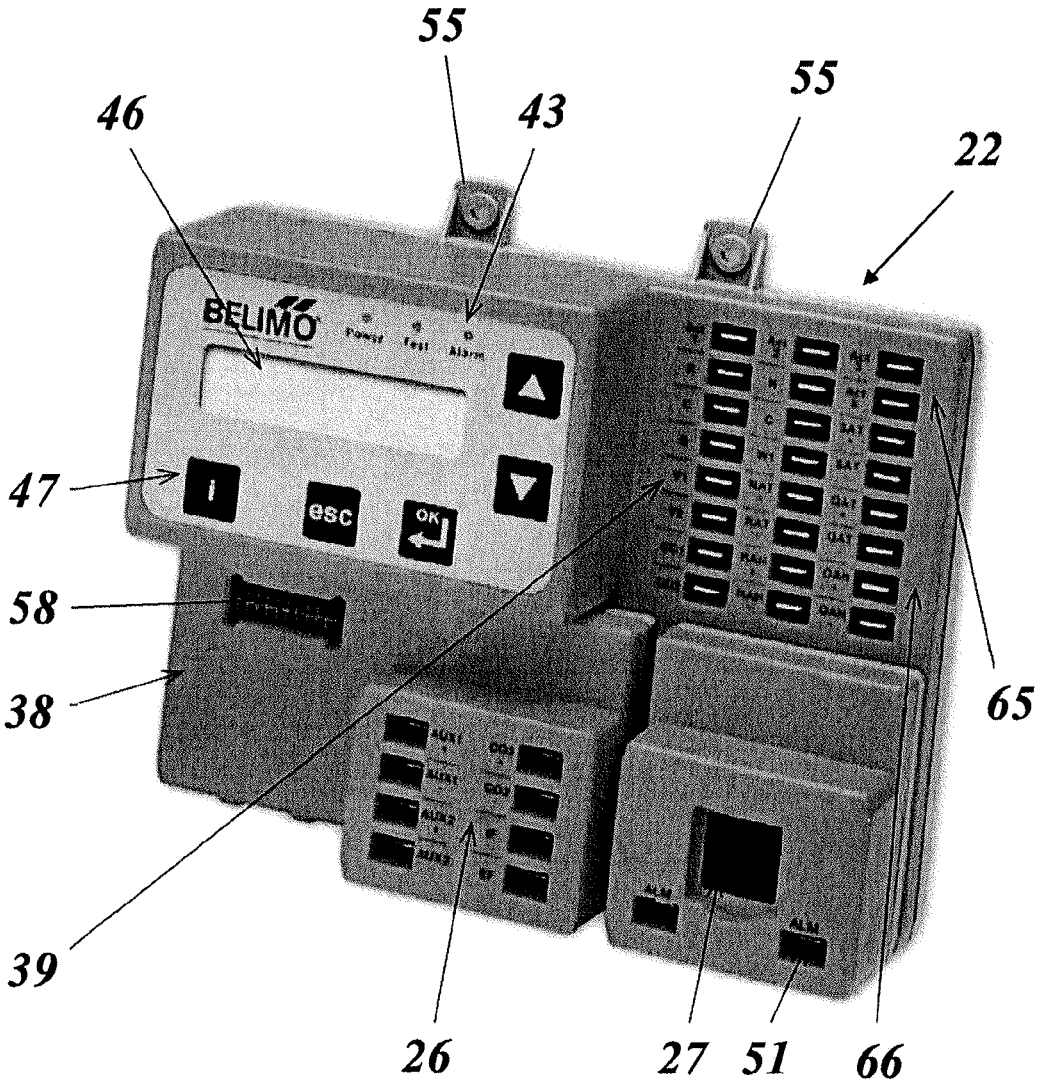

As shown in FIG. 3-5, extension modules 26, 27 and 28 are each fixed in the plugged-in position by means of a snapping clip 61. The respective extension module connectors 56, 57, 58, 63 are coded to avoid that they are plugged in at a wrong position. Furthermore, extension modules 26, 27, 28 are electrically coded, which allows a module detection and identification of the type of each plugged-in module. Each extension module 26, 27, 28 comprises a base plate 59 and a housing 60, which is snapped on the base plate 59 and is formed with a recession 64, which allows to easily grab the module for plugging/unplugging.

The operation including setup and configuration of control unit 22 according to the invention has several unique features.

First of all, there is no factory default setup. The cooling operation of the HVAC system 10 or roof top unit RTU will not function without first setting up the control unit 22. This is to prevent a contractor from simply leaving the unit in default mode. At minimum, the contractor must set up minimum position of the dampers D1, D2, D3 and enter a parameter relevant for the actual climate zone, e.g. a ZIP Code (to set the climate zone high limit, as disclosed in document US 2010/0170272 A1) to enable auto-operation of the control. Thus, an improper setup is excluded.

Then, there is an automatic adaptation of the menu structure of control unit 22. The menus and sub-menus of control unit 22 are internally configured to what is attached externally. Until an accessory device is attached to control unit 22, it does not show up in the menu. If for example CO2 sensor 37 is not detected by control unit 22, no menu points or setting related to demand controlled ventilation DCV are shown in menu. If a new accessory device is installed prior to first setup, values related to this device must be entered via the man machine interface before the HVAC system or RTU operates. If CO2 sensor 37 is installed after initial setup, a prompt to setup in generated and pops up. If the necessary setup is not done, the economizer continues to operate as it has before without the new function, until a setup enables the new function.

When a parameter related to the actual climate zone, especially the ZIP code, is entered into control unit 22 the local changeover temperature for auto compliance with the relevant energy codes is set (auto high limit changeover).

Further assistance at setup of control unit 22 is given by evaluation for plausibility of values entered during setup. In case that a value is not plausible, correction and feedback may be initiated. An on-board information/help feature can be activated and used to retrieve helpful information during setup or service. When an "i" appears as last character on the LCD display 46, the user can push the help or "i" button 47 to obtain information about setup up, alarm etc. This on-board help is context sensitive: When the help or "I" button 47 is pressed the help information for the currently active menu item is shown.

Although control unit 22 is configured to operate automatically, a specific manual mode allows a service technician to manually operate compressors C1, C2 of cooling device 19, exhaust fan 21, indoor fan speed of indoor fan 18, and damper position of dampers D1, D2 and D3 for a timed temporary period for commissioning, maintenance, or service.

As there are several standards and/or regulations like "California Title 24" and other Lead Points and Certificates relevant for the operation of HVAC systems, control unit 22 can be operated through special test and verification sequences to support and ensure compliance with such standards/regulations, especially by visual verification in interaction with a user/commissioner. An "on-board" acceptance test includes a built-in test routine for Title 24 (T24). It follows the format of form MECH-5A Certificate of Acceptance of California in a step by step operation and visual verification. Additional test modes RTU, DCV, ventilation configure economizer EC to override by disabling automatic DCV or economizer function. No wires need to be removed. During the test mode damper actuator 17 is commanded to temporarily run with a higher speed in order to save time to complete the tests.

Control unit 22 further has a statistics capability, which gathers the total operating hours of the various aggregates in general and in the various operating modes. In addition, the occurrence of errors is registered. Regarding the hours of operation, control unit 22 counts and maintains from the first startup the hours of operation of DCV, compressors C1, C2, economizing, integrated cooling, ventilation, heating, and the time of being unoccupied and occupied, indoor fan 18 (IF) part load operation, indoor fan 18 (IF) full load operation, exhaust fan 21 (EF) operation and mechanical cooling.

Also, an alarm history is generated and stored. Up to 10 historic alarms can be reviewed. This feature enables a service technician to identify a potential problem that existed when he was not present and may have reset, making troubleshooting easier.

An enhanced alarm and error supervision is based on set points, sensor values and thermostat inputs, such as:

- Y2 (thermostat cooling requirement stage 2) is present but no Y1 (thermostat cooling requirement stage 1). If wires from thermostat 31 are reversed or there is a failure of thermostat 31 and only a Y2 signal is received at control unit 22, then it alarms and enables first stage cooling;
- W1 (thermostat heating requirement stage 1) is present together with Y1 (thermostat cooling requirement stage 1) or Y2 (thermostat cooling requirement stage 2);
- Missing supply or mixed air temperature (SAT/MAT) drop after a compressor C1, C2 being switched on. If within 4 min, supply air temperature SAT (or MAT) does not decrease at least 5 degrees, then an alarm is generated (mechanical cooling alarm);
- Plausibility check of outdoor air temperature OAT and supply air temperature SAT, respectively mixed air temperature MAT, in free cooling. If dampers D1, D2, D3 are open (>85%) and supply air temperature SAT is not within range of outdoor air temperature OAT then an alarm is generated (economizing alarm).
- If actuator feedback (5Act) doesn't achieve actuator input during opening or closing, then an alarm in generated (stuck damper alarm);
- Also, an unusual configuration is recognized: Example: A multi-stage indoor fan 18 together with a single compressor cooling unit;
- If the circuit to a compressor C1, C2 is open (compressor is not detected), then an alarm is generated (i.e. if contactor coil of the compressor fails, refrigerant pressure controls or compressor current devices open up).

An enhanced error and failure management comprises the following features:

- Using a calculated damper setpointfor damper feedback related logic in case of missing damper feedback (5Act);
- A strategy to keep decision upright in case of sensor failure is used according to the following table:

| | Compulsory sensors | | | | Failed sensors | | | |
|---|---|---|---|---|---|---|---|---|
| Economizing Strategy | OAT | OAH | RAT | RAH | OAT | OAH | RAT | RAH |
| Economizing disabled | | | | | ↑ | ↑ | ↑ | ↑ |
| Single Temperature | x | | | | | ↑ | | |
| Differential Temperature | x | | x | | | | ↑ | |
| Single Enthalpy | x | x | | | | ↑ | | ↑ |
| Differential Enthalpy | x | x | x | x | | | ↑ | ↑ |

*Economizing is enabled @ RAH <55% rH/disabled @ RAH >65% rH

If a sensor returns a value out of normal working range, an alarm will be initiated. Diagnostic and mode are dependent on sensor and set up. (e.g. if OAT or SAT fails then economizing is disabled, alarm generated and mechanical cooling is enabled, if RAH fails then alarm is sounded and economizer operation is run by single outdoor enthalpy . . . ); if a Sensor is not detected (sensor failure or missing due to broken wire etc. . . . ) behavior is same as above;

Y2 present without Y1—If wires from thermostat are reversed or there is a failure of thermostat and only a Y2 signal is received at the ZIP, then the ZIP alarms and enables first stage cooling The table shown above has the following meaning:

Change when Return Air Temperature Sensor RAT Fails:

If configuration was for differential dry bulb, then decision if free cooling is possible or not is based on single dry bulb;

If configuration was for differential enthalpy, then decision if free cooling is possible or not is based on Single Enthalpy.

Change when Return Air Humidity Sensor RAH Fails:

Decision if Free cooling is possible or not is based on single Enthalpy (instead of differential enthalpy)

Change when Outdoor Air Humidity Sensor OAH Fails:

If configuration was for single Enthalpy, then Free cooling is not anymore possible (due to high humidity possibility);

If configuration was for differential enthalpy, then decision if free cooling is possible or not is based on differential dry bulb using RAH to monitor room humidity not getting too high.

Change when Outdoor Air Temperature Sensor OAT Fails:

Free cooling not possible

A further feature of control unit 22 is an automated and manually adapted damper range of the dampers D1, D2, D3 (the mechanical range is adapted to the 0-100% setpoint and feedback signal, including a plausibility check.) In the process of running an acceptance test, if the damper rotation is intentionally limited (rotation less than 90°), control unit 22 will adapt to the intended angle to provide full resolution (e.g. if dampers D1, D2, D3 are designed for 80° rotation then it will be adapted such that this shows as 100% open) Without calibration control unit 22 will alarm at angles less than <77° (85% open—Note: There is need to leave some room for damper hysteresis as construction of these has not changed). The mechanical damper angle range also can be manually set, e.g. by means of a commissioning tool.

Another important feature is brownout detection to shut down aggregates, e.g. compressors C1, C2. Brownout detection is based on frequency, primary, secondary or device internal voltage long-term and momentary development. A "brownout" happens when the voltage drops below 20% nominal line voltage. In this case control unit 22 prevents compressors C1, C2 from being enabled. Control unit 22 continues to display and operate. When power is restored to normal levels, compressor enablement is random. This prevents multiple compressors in multiple RTUs from starting at the same time in order to prevent a power drain that could re-initiate the brownout situation. Furthermore, a compressor interlock for simultaneous on and off is provided, protecting electrical network by limiting total inrush current.

After a power-up, a random on delay for the compressors is applied. Preventing starting all compressors (in an area with a lot of RTUs) at the same time avoids a power drain and—in case of a previous blackout or brownout—a possibility for a new brownout or blackout.

Random delay as well as compressor interlock are not limited to the case of a brownout but apply in general, whenever a power-up is necessary. Brownout detection with disabling the compressors, random on delay and compressor interlock are independent features for stabilizing and relieving the grid.

In addition, an enhanced compressor management of compressors C1, C2 for optimization is established to decrease energy consumption, and increase comfort and lifetime of components, such as:

Limitation of on/off cycles per hour;

A special temperature threshold to deny or enable the second cooling stage (SAT Y2 Limit)

Second stage delay/lock out mechanical cooling: Control unit 22 will not initiate 2 stages (C1 in integrated and C2 in mechanical cooling mode) at initial call allowing for first stage to satisfy load. This may result in a retardation of space temperature reduction, but enhances energy saving (e.g. if thermostat 31 activates both demands (Y1, Y2), the second stage is delayed to see if the first stage can satisfy desired supply air temperature (e.g. 55° F.) including some tolerance, e.g. 2° F.).

The operation of exhaust fan 21 is fiercely influencing pressure situation in RTU, leading to supply respectively mixed air temperature change, forcing the dampers D1, D2 and D3 to react. This could end up in an instable situation with cycles of exhaust fan 21 on and off. Increasing stability of the exhaust fan operation is achieved with logic combining:

Adjusting supply respectively mixed air temperature set point;

Gradient of supply respectively mixed air temperature change;

Adaptive change of on/off threshold for exhaust fan 21;

Modulating damper to maintain SAT, respectively MAT (mixed air temperature) set point.

Furthermore, the threshold for exhaust fan 21 operation may be adjusted depending on indoor fan speed. The exhaust fan 21 is turned on based on a predetermined position threshold of the indoor fan 18 in order to allow for a proper pressurization of the building. In case of two-speed operation of the indoor fan 18 control unit 22 allows for:

A setting for a threshold to turn on/off exhaust fan 21 at normal speed fan operation;

A second setting for a threshold to turn on/off exhaust fan 21 at reduced speed fan operation.

The methods or operation of control unit 22 have been described above for an embodiment of control unit 22 a modular configuration comprising a base module 23 and one or more extension modules 26, 27, 28. However, these methods of operation more general apply as well to control units without such a modular configuration.

LIST OF REFERENCE NUMERALS

10 HVAC system
11 space (e.g. room)
12 supply air duct
13 return air duct
14 exhaust air duct
15 recirculating duct
16 outdoor air intake duct
17 damper actuator
18 indoor fan
19 cooling device (coil)
20 heating device
21 exhaust fan
22 control unit
23 base module
24 control circuit
25 man machine interface (MMI)
26 extension module (energy module)
27 extension module (communication module)
28 extension module (additional)
29 remote unit
30 alarm device
31 thermostat
32 outdoor air temperature sensor
33 outdoor air humidity sensor
34 supply air temperature sensor
35 return air temperature sensor
36 return air humidity sensor
37 CO2 sensor
38 I/O platform
39 I/O area
40 MMI housing part
41 arrow up button
42 arrow down button
43 power indicator (LED)
44 test indicator (LED)
45 alarm indicator (LED)
46 display (e.g. 2×16 characters LCD)
47 help button
48 escape button
49 enter button
50,51 alarm connector
52 communication connector (e.g. RJ45)
53,59 base plate
54,60 housing
55 mounting tab
56,57,58 extension module connector part (female)
61 snapping clip
62 catch
63 extension module connector part (male)
64 recession
65 actuator connectors
66 temperature sensor connectors
C1,C2 compressor
CR1-CR5 connector row (e.g. ¼" male spade connectors)
D1-D3 damper
EC economizer
OA outdoor air

What is claimed is:

1. A control unit (22) for a heating, ventilation and air conditioning (HVAC) system (10) comprising an economizer (EC), which economizer (EC) is configured to introduce outdoor air (OA) into the HVAC system (10) for cooling and/or ventilation purposes in a manner controlled by said control unit (22), said control unit (22) comprising a base module (23) with: a control circuit (24), a man machine interface (25) connected to said control circuit (24), and first input/output (I/O) means (39, CR1, CR2, CR3) for connecting at least one sensor (32, . . . ,36) of said HVAC system to said control circuit (24) and for delivering at least one control signal from said control circuit (24) to control the operation of said economizer (EC), whereby said base module (23) is configured to optionally receive at least one extension module (26, 27, 28), which can be snapped on and electrically connected to said base module (23) for expanding the functionality of said control unit (22) and wherein said first I/O means (39, CR1, CR2, CR3) comprises connecting means (1Act, 2Act, 3Act, 5Act) for connecting an actuator (17), connecting means (Y1, Y2, W1) for connecting a thermostat (31), and at least one temperature connecting means or humidity connecting means.

2. Control unit as claimed in claim 1, wherein said base module (23) is configured to receive said at least one extension module (26, 27, 28) such that the electrical connection between said at least one extension module (26, 27, 28) and said base module (23) is automatically established, when said at least one extension module (26, 27, 28) is snapped on said base module (23).

3. Control unit as claimed in claim 2, wherein a plug-in connector (56, 57, 58, 63) is provided for electrically connecting said base module (23) and said at least one extension module (26, 27, 28), one part of said plug-in connector (56, 57, 58, 63) being integrated into said base module (23) and the other part of said plug-in connector (56, 57, 58, 63) being integrated into said at least one extension module (26, 27, 28).

4. Control unit as claimed in claim 1, wherein said base module (23) is configured to receive a plurality of extension modules (26, 27, 28), wherein plug-in connectors (56, 57, 58, 63) are provided for electrically connecting said base module (23) and each of said extension modules (26, 27, 28), one part of each plug-in connector (56, 57, 58, 63) being integrated into said base module (23) and the other part of each plug-in connector (56, 57, 58, 63) being integrated into an extension module (26, 27, 28), whereby said plug-in connectors (56, 57, 58, 63) are individualized so that each plug-in connector (56, 57, 58, 63) can only be used with one type of extension module.

5. Control unit as claimed in claim 3, wherein said base module (23) is provided with first latching means (62) and said at least one extension module (26, 27, 28) is provided with second latching means (61) configured to co-operate with said first latching means (62) such that said at least one extension module (26, 27, 28) is locked in place on said base module (23), when it is plugged into said plug-in connector (56, 57, 58, 63).

6. Control unit as claimed in claim 5, wherein said first and second latching means (61, 62) comprise an elastically bendable snapping clip (61) and one or more catches (62), whereby said snapping clip (61) glides over and latches behind said catches (62), when said at least one extension module (26, 27, 28) is plugged into said plug-in connector (56, 57, 58, 63), and whereby said at least one extension module (26, 27, 28) can be released by elastically bending said snapping clip (61).

7. Control unit as claimed in claim 6, wherein said elastic snapping clip (61) is provided at said at least one extension module (26, 27, 28), and said catches (62) are arranged at said base module (23).

8. Control unit as claimed in claim 1, wherein said at least one extension module (26, 27, 28) is provided with second I/O means (CR4, CR5; 50, 51, 52) for electrically connecting said at least one extension module (26, 27, 28) and thereby said base module (23) with further units (18, 21, 29, 30, 37) being relevant for the operation of the HVAC system (10).

9. Control unit as claimed in claim 8, wherein said at least one extension module (26) is configured to enable a demand controlled ventilation (DCV) operation of the HVAC system (10), and said second I/O means comprises input means for a CO2 sensor (37) and output means for controlling an exhaust fan (21) within said HVAC system (10).

10. Control unit as claimed in claim 9, wherein said second I/O means comprise further output means for controlling an indoor fan (18) within said HVAC system (10).

11. Control unit as claimed in claim 8, wherein said at least one extension module (27) is configured to enable a communication with remote devices (29, 30).

12. Control unit as claimed in claim 11, wherein said remote devices (29, 30) comprise an alarm device (30).

13. Control unit as claimed in claim 11, wherein said remote devices (29, 30) comprise a remote unit (29) for exchanging data with said control unit (22).

14. Control unit as claimed in claim 1, wherein said base module (23) comprises a base plate (53) and a housing (54) mounted on said base plate (53), which housing (54) encloses said control circuit (24) and said man machine interface (25), whereby said housing (54) comprises on its upper side an I/O platform (38), on which said first I/O means (39, CR1, CR2, CR3) is arranged, and which is configured to receive said at least one extension module (26, 27, 28), and further comprises a man-machine interface (MMI) housing part (40), which projects from said I/O platform (38) and contains said man machine interface (25).

15. Control unit as claimed in claim 14, wherein said first I/O means comprises a plurality of connector rows (CR1, CR2, CR3), which are arranged in a separate I/O area (39).

16. Control unit as claimed in claim 15, wherein said at least one extension module (26, 27, 28) can be snapped on said base module (23) outside said I/O area (39) without changing the footprint of said base module (23).

17. Control unit as claimed in claim 15, wherein each said connector row (CR1, CR2, CR3) comprises a plurality of individual male spade connectors.

18. Control unit as claimed in claim 1, wherein said control circuit (24) and said sensor connecting means (+SAT, −SAT; +OAT, −OAT; +OAH, −OAH; +RAT, −RAT; +RAH, −RAH) are configured to be connected to analog sensors.

19. Control unit as claimed in claim 1, wherein said connecting means (1Act, 2Act, 3Act, 5Act) for connecting an actuator (17) comprises a separate connector (5Act) for receiving a feedback signal from said actuator (17), said feedback signal containing information about the actual position of said actuator (17).

20. Control unit as claimed in claim 1, wherein said first I/O means (39, C1, C2, C3) further comprises eighth connecting means (CC1, CC2) for connecting first and second compressors of a two-stage cooling device (19) within said HVAC system (10).

21. Control unit as claimed in claim 1, wherein said man machine interface (25) comprises a display (46) for displaying menu points, onboard information, set values and real time operating information, a plurality of push buttons (41, 42, 47, 48, 49) for inputting various commands, and a plurality of optical indicators (43, 44, 45) for indicating status information.

22. Control unit as claimed in claim 21, wherein said display (46) is an enhanced transflective backlit liquid crystal display (LCD display), with two rows of 16 characters each.

23. Control unit as claimed in claim 21, wherein said plurality of push buttons (41, 42, 47, 48, 49) comprises a separate help button (47) for retrieving and displaying context sensitive help information stored with said control circuit (24).

* * * * *